US008714418B2

(12) United States Patent
Kumar et al.

(10) Patent No.: US 8,714,418 B2
(45) Date of Patent: May 6, 2014

(54) METHOD AND SYSTEM FOR ARRANGING AND STORING CLOTHING

(75) Inventors: Clare Shanta Kumar, Toronto (CA); Yuriko Zakimi, Mississauga (CA)

(73) Assignee: Flo Collection Inc., Toronto (CA)

( * ) Notice: Subject to any disclaimer, the term of this patent is extended or adjusted under 35 U.S.C. 154(b) by 10 days.

(21) Appl. No.: 13/582,796

(22) PCT Filed: Mar. 11, 2011

(86) PCT No.: PCT/CA2011/000246
§ 371 (c)(1),
(2), (4) Date: Sep. 5, 2012

(87) PCT Pub. No.: WO2011/109893

PCT Pub. Date: Sep. 15, 2011

(65) Prior Publication Data

US 2013/0001261 A1 Jan. 3, 2013

Related U.S. Application Data

(60) Provisional application No. 61/312,930, filed on Mar. 11, 2010.

(51) Int. Cl.
*A41H 33/00* (2006.01)

(52) U.S. Cl.
USPC ..... 223/37

(58) Field of Classification Search
USPC ..... 223/37, 38; 5/655
See application file for complete search history.

(56) References Cited

U.S. PATENT DOCUMENTS 4,126,252 A * 11/1978 Wasserman ..... 223/87
5,011,052 A * 4/1991 Craig ..... 223/37

(Continued)

FOREIGN PATENT DOCUMENTS

CN 201312700 Y 9/2009
GB 2328920 A 3/1999

(Continued)

OTHER PUBLICATIONS

How Dini. "How to Organize your Dresser Drawers and Fold Clothes." Internet. Available at http://www.youtube.com/watch?v=nJAYRXjZoMY. Uploaded Mar. 6, 2009. Last visited Sep. 6, 2012.

(Continued)

*Primary Examiner* — Nathan Durham
(74) *Attorney, Agent, or Firm* — Andrew McAleavey; PatentBest

(57) ABSTRACT

A clothing folding system is provided comprising: one or more folding guides comprising: two or more sections of substantially rigid material: and a flexible web disposed between any two of the two or more sections of substantially rigid material, enabling the folding guide to be folded along the length of the flexible web: wherein the one or more folding guides are sized so as to enable each folding guide to be used to place the folding guide in contact with an article of clothing, folding the article of clothing in a folding pattern defined by folding each flexible web of the folding guide, wherein the folding guide remains folded within the article of clothing: and wherein the folding of multiple articles of clothing using the folding guides presents a plurality of articles of clothing that are substantially consistent in shape and size in their folded state, and such folded articles of clothing thereby are suitable to be stored in a sustainable organized arrangement. A specific structure for the folding guide is provided as well as a related folding method for clothing, using the folding guide. A related method is provided for folding articles of clothing. The system may include a computer implemented system to enable a user to provide as input one or more parameters for articles of clothing and available storage spaces: the system generating a recommended set of folding guide requirements to meet the user's input parameters.

19 Claims, 20 Drawing Sheets

(56) References Cited

U.S. PATENT DOCUMENTS

| | | | | |
|---|---|---|---|---|
| 5,119,307 | A | 6/1992 | Blaha et al. | |
| 5,154,329 | A * | 10/1992 | Dorfmueller | 223/37 |
| 5,947,366 | A | 9/1999 | Feldmann et al. | |
| 6,279,791 | B1 * | 8/2001 | Betman et al. | 223/37 |
| 6,360,927 | B1 * | 3/2002 | Barker | 223/37 |
| 6,561,392 | B2 * | 5/2003 | Lapace et al. | 223/37 |
| 6,814,269 | B1 * | 11/2004 | Fernandez | 223/37 |
| 7,065,814 | B2 * | 6/2006 | Rutkowski | 5/655 |
| 7,992,712 | B2 * | 8/2011 | Rosland | 223/37 |
| 8,011,170 | B2 * | 9/2011 | Smith et al. | 223/37 |

FOREIGN PATENT DOCUMENTS

| | | | |
|---|---|---|---|
| JP | 10203575 | A | 8/1998 |
| WO | 0248008 | A1 | 6/2002 |

OTHER PUBLICATIONS

International Search Report for PCT/CA2011/000246, dated Jul. 15, 2011.

* cited by examiner

METHOD AND SYSTEM FOR ARRANGING AND STORING CLOTHING

PRIORITY CLAIM

This application claims the benefit of U.S. Patent Application No. 61/312,930, filed on Mar. 11, 2010, and which is incorporated herein by reference.

FIELD OF THE INVENTION

The present invention relates to a clothing folding apparatus. The present invention further relates to a system for folding and storing clothing.

BACKGROUND OF THE INVENTION

Clothing, whether stored on a shelf, in a closet, drawer, storage bin, suitcase or other container can be time consuming to arrange on the shelf or in the container in a neat manner. And even if arranged in a neat manner, it is difficult to maintain the clothing in a neat state. Items of clothing stored using conventional containers, or means of arranging clothing in the containers, can over time result in the stored clothing becoming messy, especially through removal of one or more items of clothing from the remaining stored items of clothing. This creates the need to reorganize the clothing, or otherwise it becomes more time consuming to locate specific items of clothing, and also the clothing that may have become disorganized can wrinkle. This can contribute to the need to re-launder or dry clean clothes or spend time or money pressing or steaming clothing. With certain, more fragile items of clothing, conventional clothing arranging and storing technologies can even result in damage to the clothing.

Another important consideration is space. In many residences, there is a need to optimize the use of storage space. This can help avoid the need to rent storage space for storing surplus and off-season items, which is a growing trend particularly in urban areas where space is at a premium. This leads to the No, this additional cost of renting the storage space and the significant time investment in organizing items both at the residence and at the storage space, and the trips between the storage space and the residence.

Conventional methods of arranging and storing method can be improved on to better utilize and improve access to available storage space. There is a need for a system and method that enables individuals to make better use of their existing storage space.

Using prior art systems and methods, individuals who organize their closets with a significant number of items of clothing can find it difficult to find particular items. When they are locating specific items of clothing they may disturb the organization of the items. This creates a need to re-organize the items of clothing which is time consuming.

Also, there is a growing demand for the "hotel aesthetic" in residences, including in closets for example, i.e. the sleek, modern, uncluttered look. The prior art systems and methods do not provide a cost effective and easy to use system and method for achieving and maintaining these objectives.

Certain prior art clothing folding and packing technologies are known.

For example, UK Patent Application No. 2,452,245 discloses a clothing folding and packing apparatus that is designed to enable clothing to be folded down the middle of clothing.

Another folding technology is disclosed in EP 0 7656617 A2, entitled "Frames for Packaging Articles".

U.S. patent Publication Ser. No. 12/440,356 discloses a relatively complex clothing folding and packing apparatus.

There is a need therefore for an improved method of folding clothing, and arranging and storing folded clothing that is easy to use and inexpensive to manufacture. There is also need for a low cost folding guide that enables clothing, once folded, to remain in a folded state.

SUMMARY

In one aspect of the invention, a clothing folding system is provided comprising: one or more folding guides comprising: two or more sections or panels of substantially rigid material, and an intermediate area or web disposed between any two of the two or more sections of substantially rigid material, enabling the folding guide to be folded along the length of the intermediate area or web; wherein the one or more folding guides are sized so as to enable each folding guide to be used to place the folding guide in contact with an article of clothing, folding the article of clothing in a folding pattern defined by folding each intermediate area or web of the folding guide, wherein the folding guide remains folded within the article of clothing; and wherein the folding of multiple articles of clothing using the folding guides presents a plurality of articles of clothing that are substantially consistent in shape and size in their folded state, and such folded articles of clothing thereby are suitable to be stored in an organized arrangement.

In a particular aspect of the invention, the intermediate area is presented by a flexible web disposed between any two of the sections or panels.

In another aspect of the invention, a folding guide is provided comprising: two or more sections of substantially rigid material; and an intermediate area or web disposed between any two of the two or more sections or panels of substantially rigid material, enabling the folding guide to be folded along the length of the intermediate area or web; wherein the one or more folding guides are sized so as to enable each folding guide to be used to place the folding guide such that it is contact with an article of clothing, folding the article of clothing in a folding pattern defined by folding each flexible web of the folding guide, wherein the folding guide remains folded within the article of clothing; and wherein the folding of multiple articles of clothing with the assistance of the folding guides presents a plurality of articles of clothing that are substantially consistent in shape and size in their folded state, and such folded articles of clothing thereby are suitable to be stored in an organized arrangement.

In a still other aspect of the invention a folding method is provided comprising the steps of: (a) providing a plurality of folding guides that comprise two or more sections or panels of substantially rigid material, and an intermediate area or web disposed between any two of the two or more sections of substantially rigid material, enabling the folding guide to be folded along the length of the intermediate area or web; (b) placing the folding guide in contact with a first article of clothing, folding the article of clothing with the assistance of the folding guide to achieve a folding pattern defined by folding each intermediate area or web of the folding guide, wherein the folding guide remains folded within the article of clothing; (c) repeating step (b) for the remaining articles of clothing so as to present the plurality of articles of clothing such that in their folded state they have a substantially consistent shape and size; and (d) arranging the plurality of folded articles of clothing into an organized arrangement.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF THE DRAWINGS

FIG. 2 is a side perspective view of one embodiment of the clothing folding guide of the present invention, partially folded in.

Figure 1:
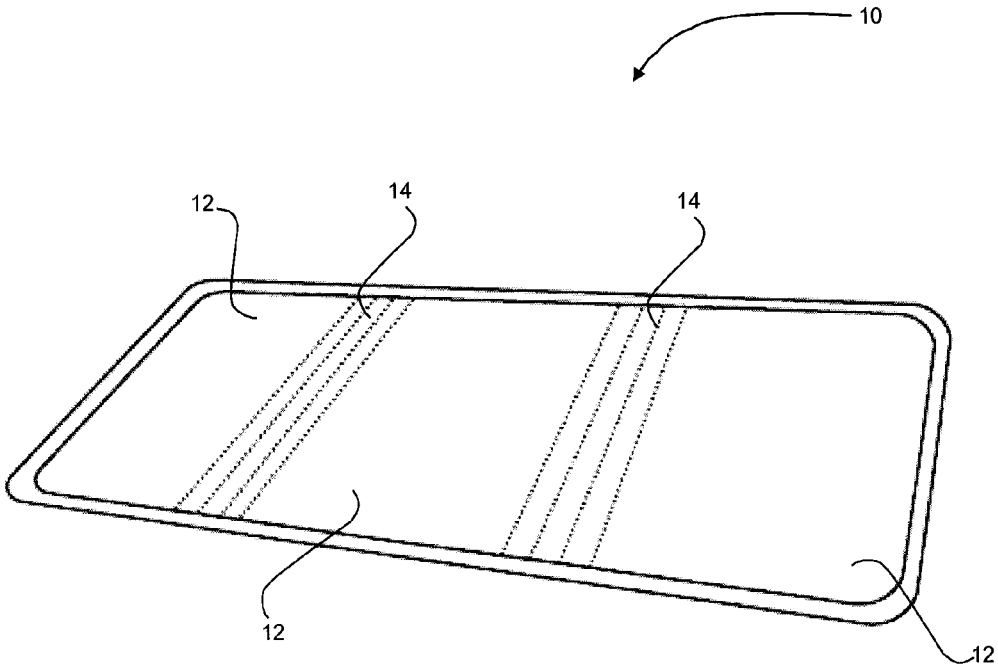
FIG. 1 is a top perspective view of one embodiment of the clothing folding guide of the present invention.

In the drawings, embodiments of the invention are illustrated by way of example. It is to be expressly understood that the description and drawings are only for the purpose of illustration and as an aid to understanding, and are not intended as a definition of the limits of the invention.

DETAILED DESCRIPTION

The present invention provides a clothing folding and storage system for improved storage of items of clothing. The clothing folding system includes a folding guide apparatus (10) or folding guide, and a series of steps for using the folding guide (10) to fold at least one clothing item, providing the folding method of the present invention. In one aspect of the invention, the item of clothing is folded around the folding guide (10), in accordance with the folding method of the present invention (explained below). Accordingly, with the present invention the item of clothing is stored with the folding guide apparatus folded within the item of clothing. This enables the item of clothing to maintain its folded position, and also that the material of the clothing continue to envelop the folding guide such that the clothing is maintained relatively wrinkle free in part because the material of most clothing tends to form around the sections or panels of the folding guide, as explained below, and by folding in accordance with the method of the invention maintain its position relative to the folding guide because of friction between the fabric of the clothing and the surfaces of the sections or panels. The present invention contemplates the use of materials or surface features that provide friction that is operable to provide this feature, which may depend on the nature of the fabric in part to avoid damage. This aspect assists in maintaining the ready to wear condition of clothing stored using the folding system.

The folding system, as explained below, may also include bags, boxes, hanging organizers, or other containers sized to receive one or more items folded using the folding guides.

FIG. 1 shows a perspective view of the folding guide (10), in one embodiment thereof. The folding guide (10) includes at least two sections or panels (12). In the embodiment of the folding guide (10) shown in FIG. 1, three sections (12) are shown. Each section (12) is provided such that it is rigid or semi-rigid so as to be operable to maintain the fabric that is disposed adjacent to the surface of the section (12) in a flat position to prevent or reduce wrinkling, once the item of clothing is folded using the folding guide (10). Each section (12) defines a surface. The surface preferably includes or consists of a material that is effective to create friction between the section (12) in the mentioned fabric. This friction helps maintain the fabric in place relative to the surface, once the clothing item has been folded around the folding guide (10), in accordance with the method of the present invention.

In accordance with the folding method, in one aspect thereof, depending on the item of clothing or the fabric, the fabric may be folded over the folding guide (10) such that the fabric is formed around the folding guide so as to smooth the fabric and then maintain it in such smoothed position based on friction between the fabric and the material of the folding guide. It should be understood that certain fabric can be damaged when stretched, and so use of the folding guide (10) should avoid such damage by avoiding unnecessary or damaging stretching. Furthermore the friction referred to above is selected so as not to damage even relatively fragile fabric.

Figure 2:
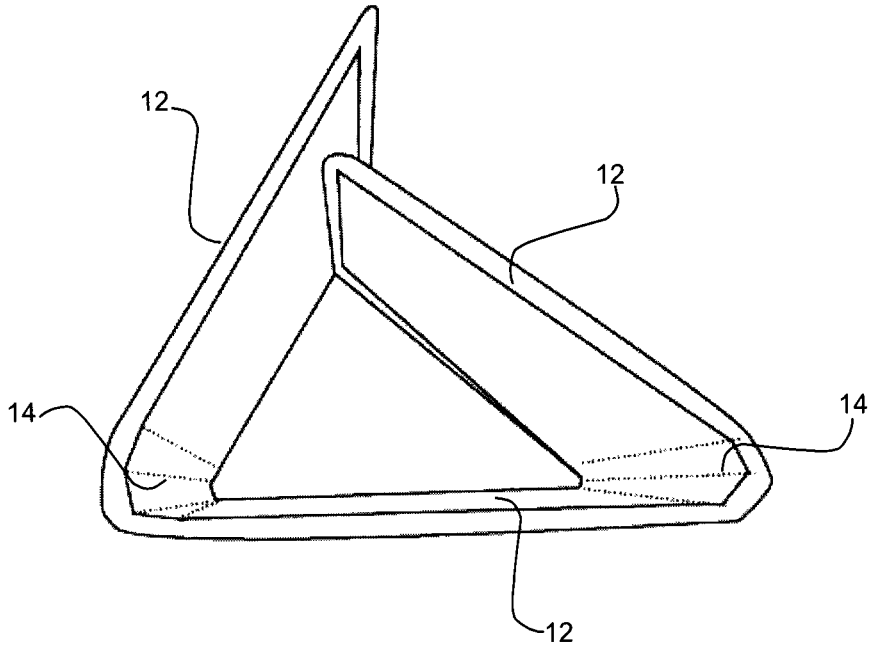
Figure 3:
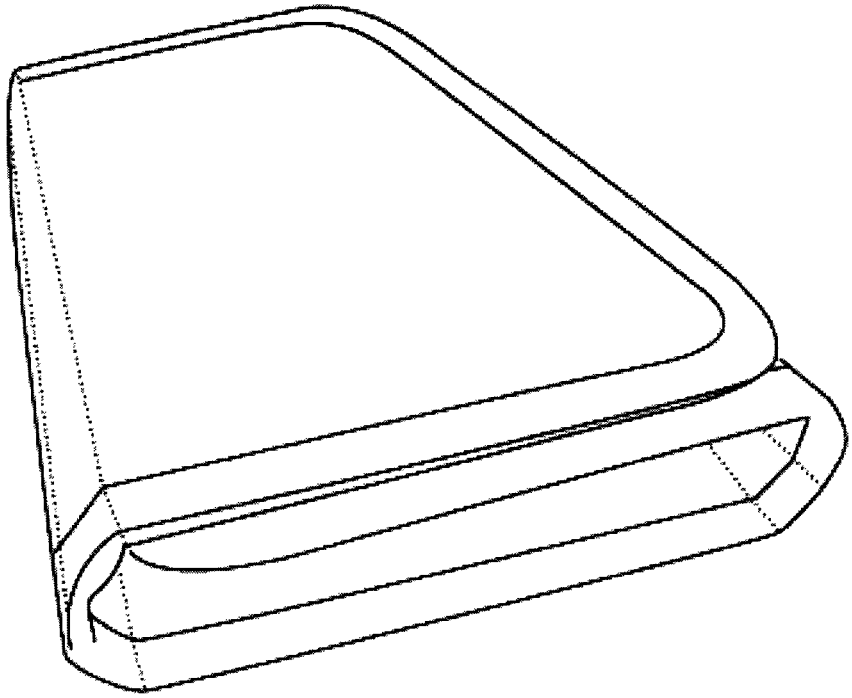
FIG. 3 is a further side perspective view of one embodiment of the clothing folding guide of the present invention, showing the first panel folded into the second middle panel and the third panel also folded into the second middle panel.
Figure 4:
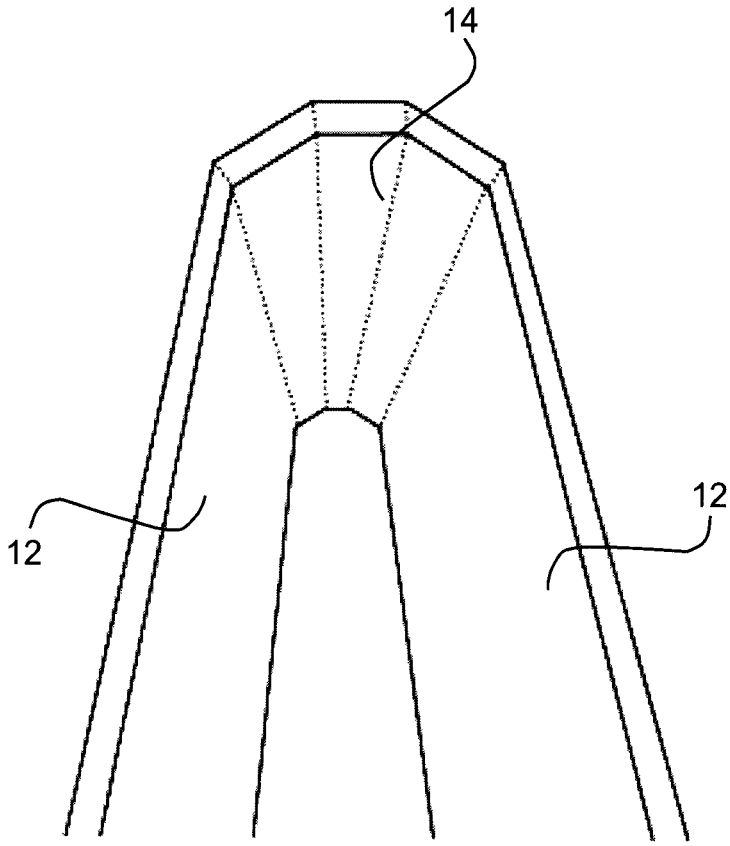
FIG. 4 is partial perspective view illustrating a bendable portion of the clothing folding guide.

Disposed between any two adjacent sections (12) is a intermediate area or flexible area (14) or web that connects the adjacent sections (12). The web (14) is disposed so as to be relatively easy to bend so as to enable the use of the folding guide (10) in accordance with the method of the present invention, as shown in FIG. 2 and FIG. 3 for example. FIG. 4 is partial view that shows the features of the web.

Figure 5:
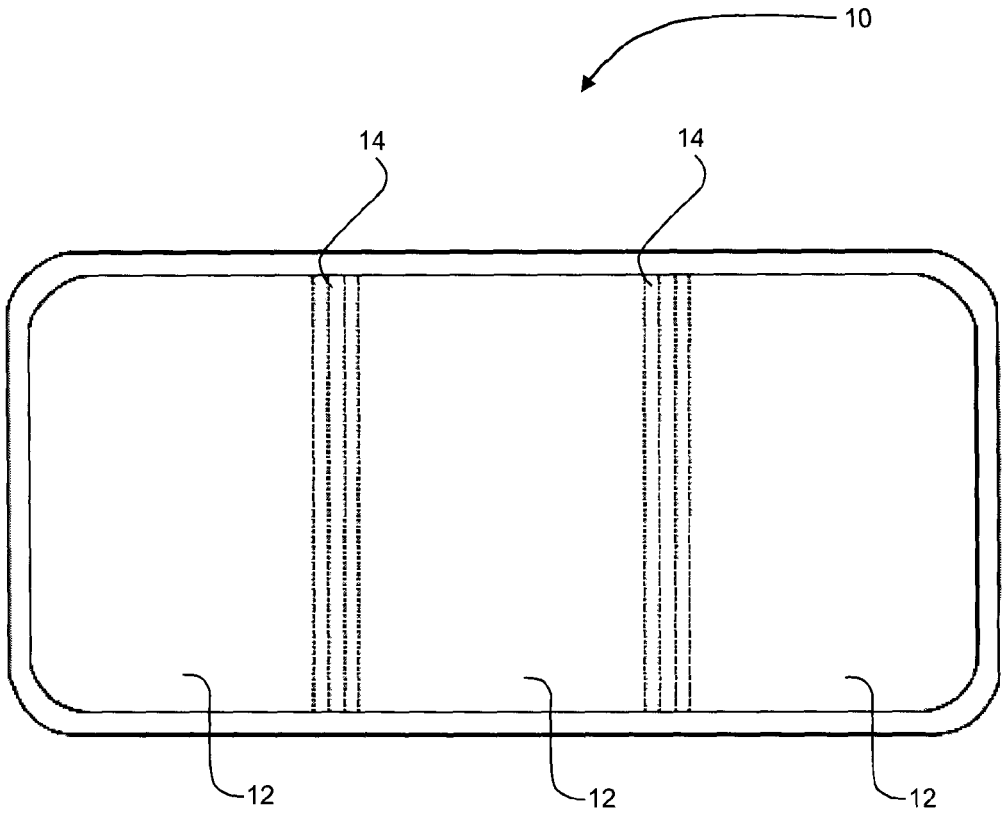
FIG. 5 is a top plan view of the clothing folding guide of the present invention.

FIG. 5 is a top plan view of the clothing folding guide of the present invention.

Figure 6:
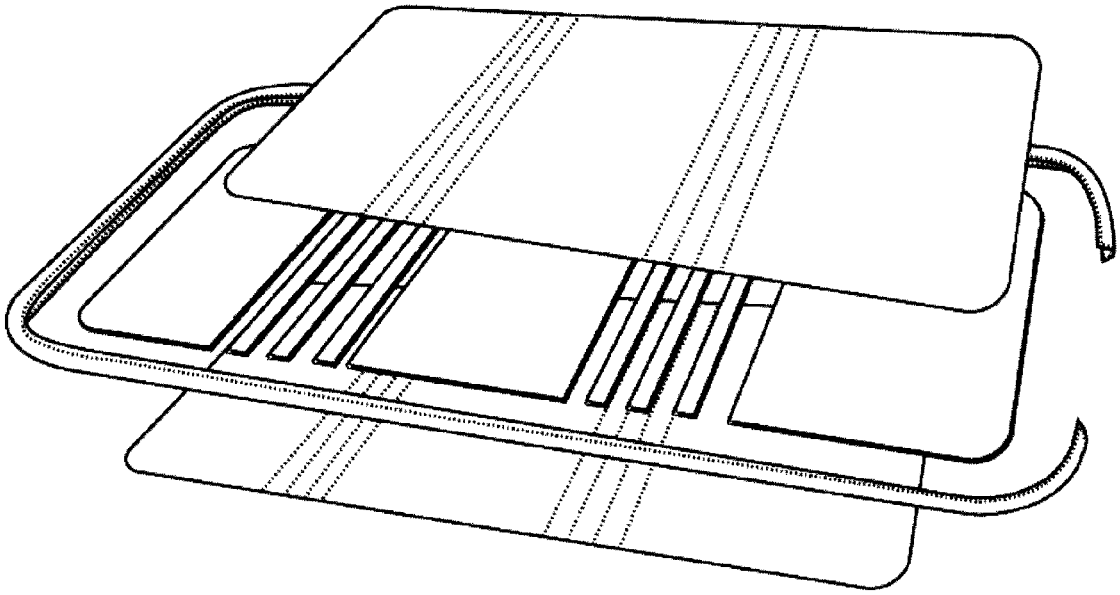
FIG. 6 is an exploded view of the clothing folding guide of the present invention, in one particular embodiment thereof.

FIG. 6 is an exploded view of a particular embodiment of the folding guide (10), showing a possible internal structure of the folding guide (10) for providing the rigid sections (12) and the flexible webs (14). As shown in FIG. 6, disposed in the interior of the folding guide (10) is a first rigid or semi-rigid panel and second rigid or semi-rigid panel, each of these corresponding to a section (12). For the web (14), a series of strips of rigid or semi-rigid material may be used. These components may then be fixed between two pieces of material sized to conform to the shape of the folding guide (10). These layers may be affixed to one another by stitching, stapling or other means of affixing, such as using a suitable adhesive, for example, so as to adhere the panels, strips, and two pieces of material, to form the folding guide (12). Contrast stitching may be used for example for decorative purposes.

It should be understood that other means of providing the sections (12) and means for bending between the sections (12), which in this embodiment are provided by means of the webs (14).

In a particular embodiment of the present invention the panels and strips are formed of cardboard having a suitable thickness. In a particular embodiment of the present invention, the folding guide is approximately 1.5 mms in thickness.

FIGS. 7*a* to 7*f* illustrate the method of the present invention, in one aspect thereof.

It should be noted that the system of the present invention comprises one or more folding guides of different sizes accommodating different items of clothing or items of clothing of different sizes. FIGS. 7*a* to 7*f* illustrate the folding of a t-shirt using the folding guide (10). A folding guide (10) of the same size can be used to fold dress shirts. Smaller folding guides (10) can be used for example to fold underwear or children's clothing for example, and larger folding guides (10) can be used for example for fabric and linens mentioned below, or for ties and scarves.

Figure 7A:
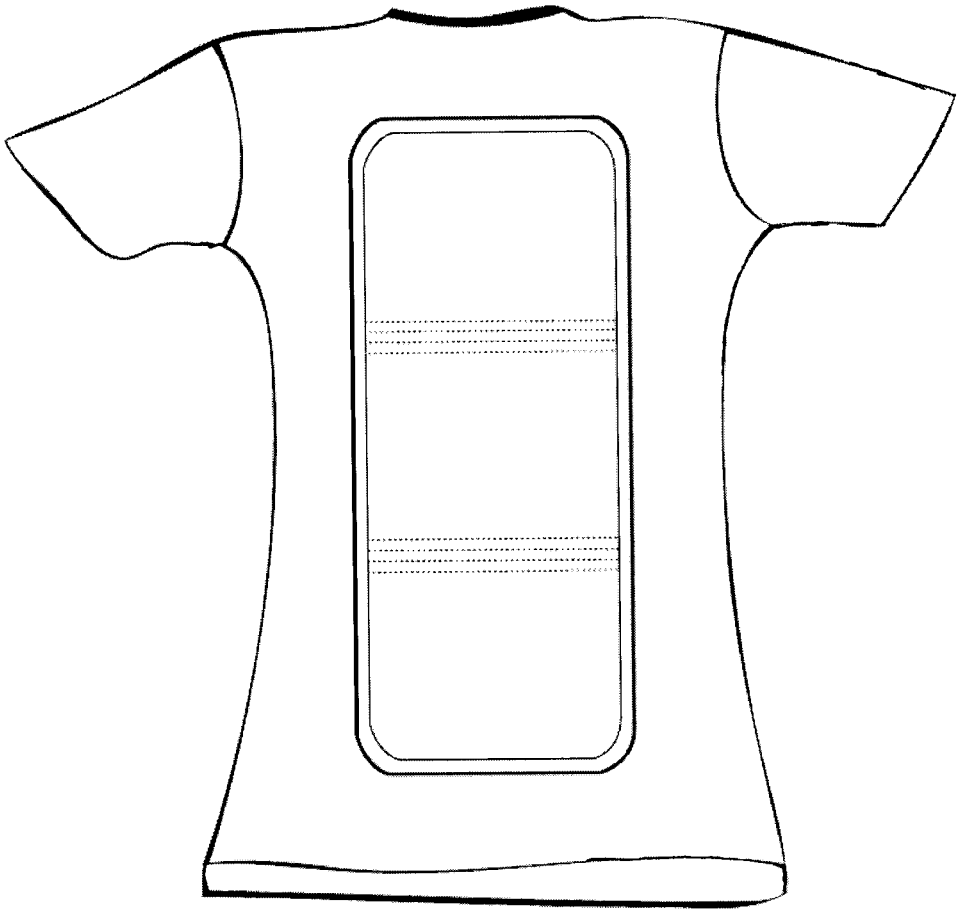
FIGS. 7*a* through to 7*g* illustrate the clothing folding method of the present invention, using the clothing folding apparatus of the present invention.
Figure 7B:
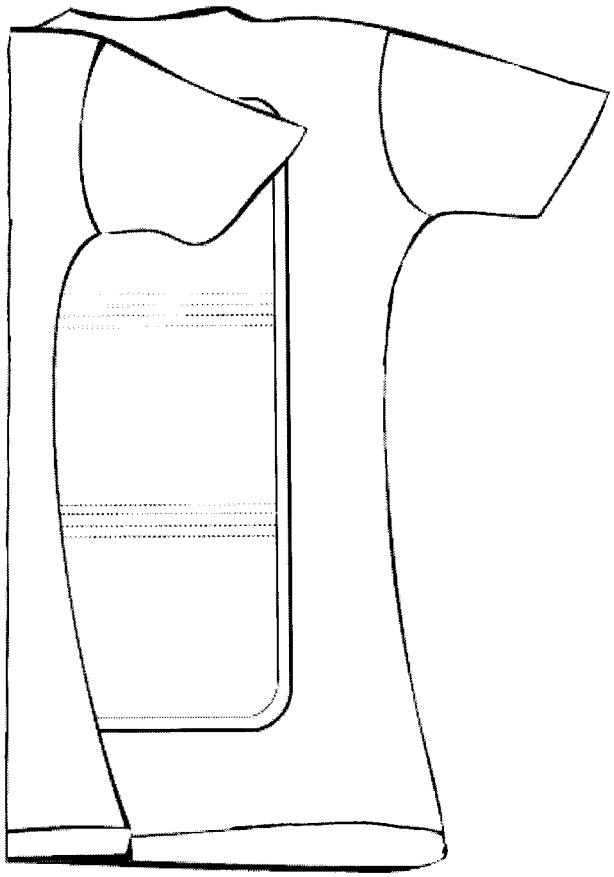
Figure 7C:
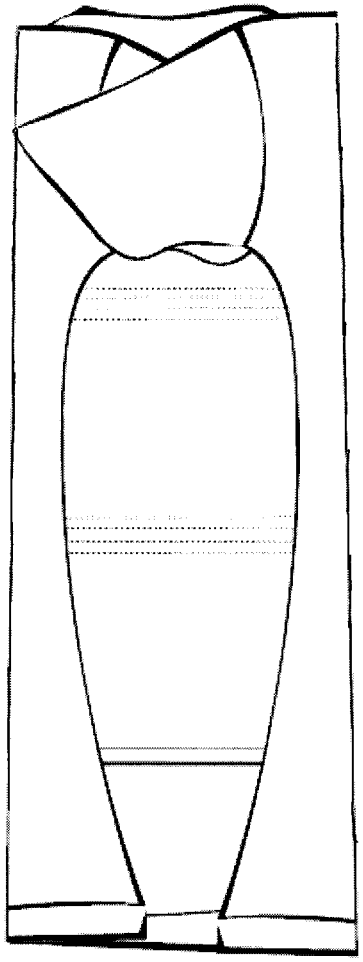
Figure 7D:
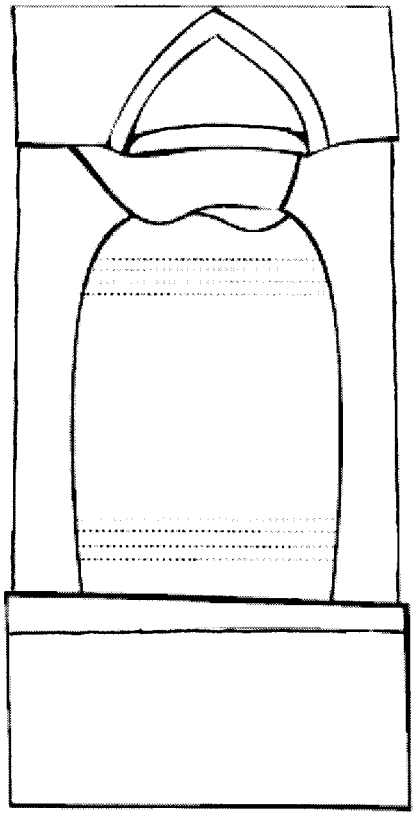
Figure 7E:
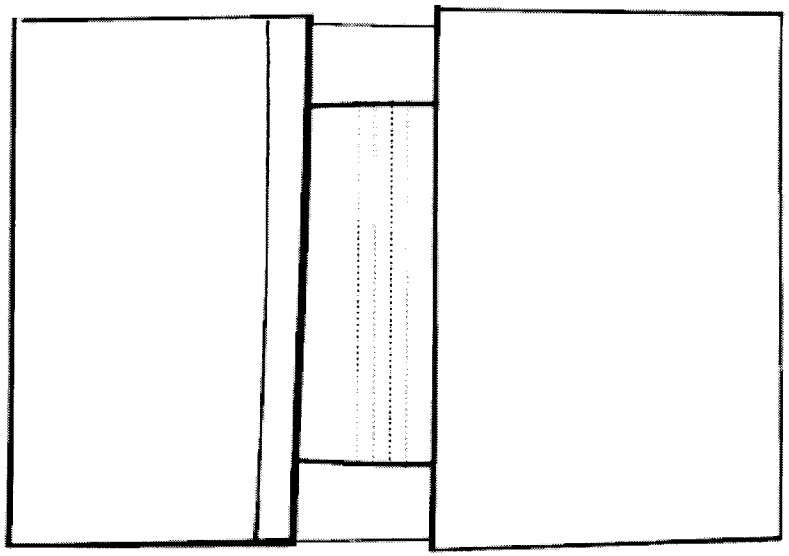
Figure 7F:
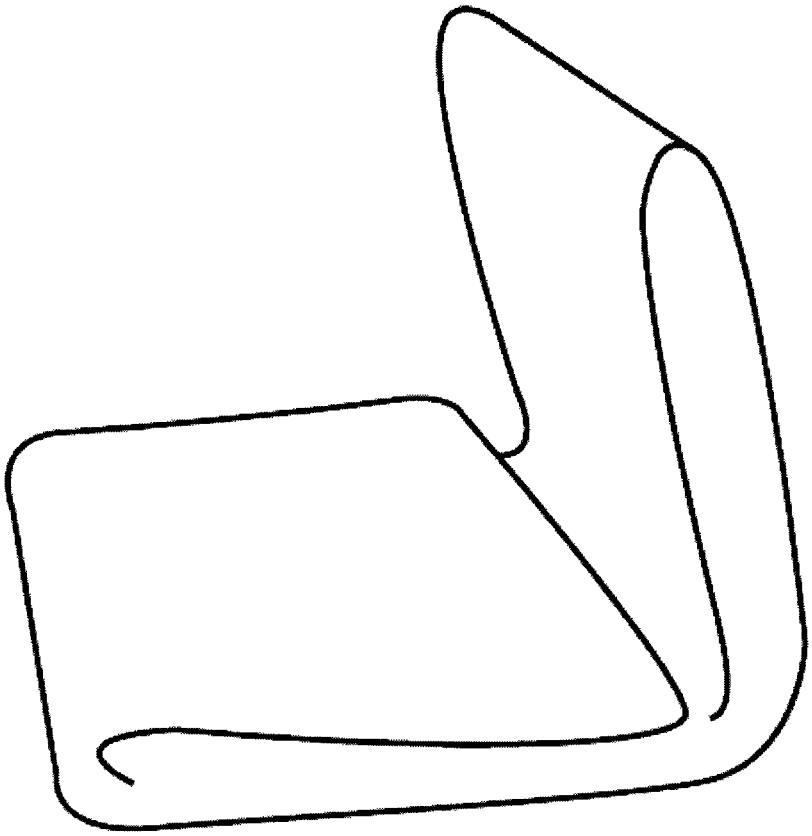
Figure 7G:
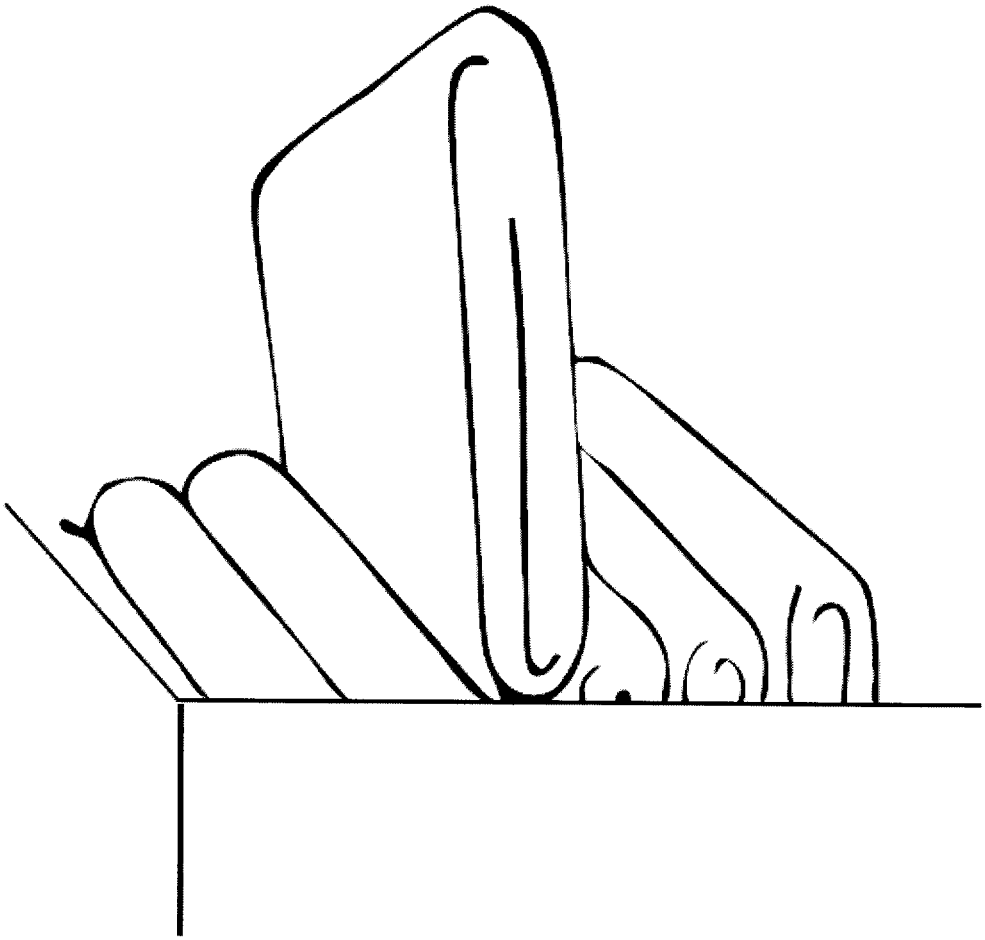

In one aspect of the invention, the folding guide (10) and related folding method enable a one or more items of clothing to be folded such that in their folded form they have a consistent shape and size, as shown in FIG. 7*g* for example. The present invention, in one aspect thereof, involves arranging the folded items, adjacent to one another, in a general vertical orientation, optionally in a box or container or some other means for maintaining the items in such general vertical orientation. This enables one or more items of clothing folded using the folding guide apparatus to be arranged within a receptacle, such as a bin or other container, drawer, or suitcase, as further illustrated in FIG. 7*g*. The receptacle can receive a larger number of items of clothing, folded in accordance with the method of the present invention in a more consistent and neat manner, than would normally be the case. This provides more efficient use of space, and the storage of items of clothing in a compact way that ensures that they remain wrinkle free.

Figure 8:
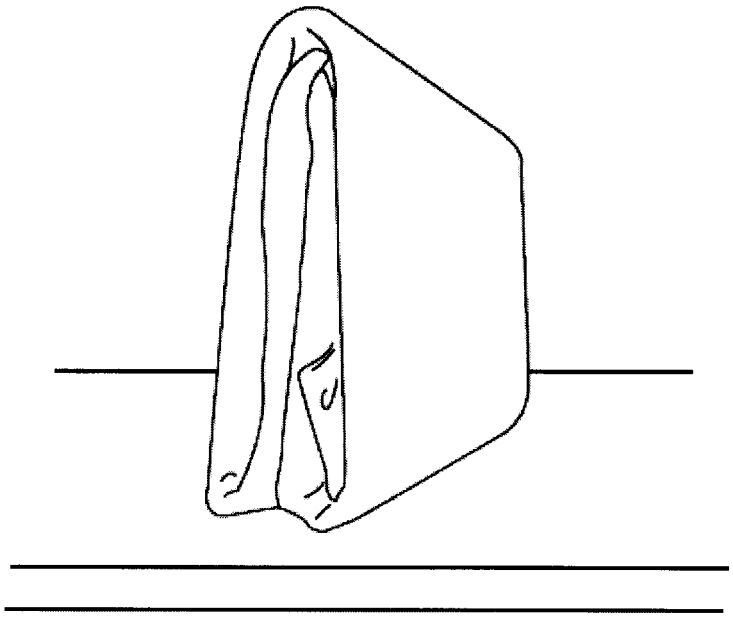
FIG. 8 is a perspective view illustrating an article of clothing folded with the folding guide.

It should be understood that, as shown in FIG. 8, that the folding guide is designed so that when an article of clothing is folded using the folding guide, the folded article of clothing with the folding guide folded within the article of clothing, tends to be self-supporting. Consequently, clothing folded using the folding guide of the present invention may be organized on shelves in a way that enables the placement of the articles of clothing vertically in an organized and compact way.

Figure 9A:
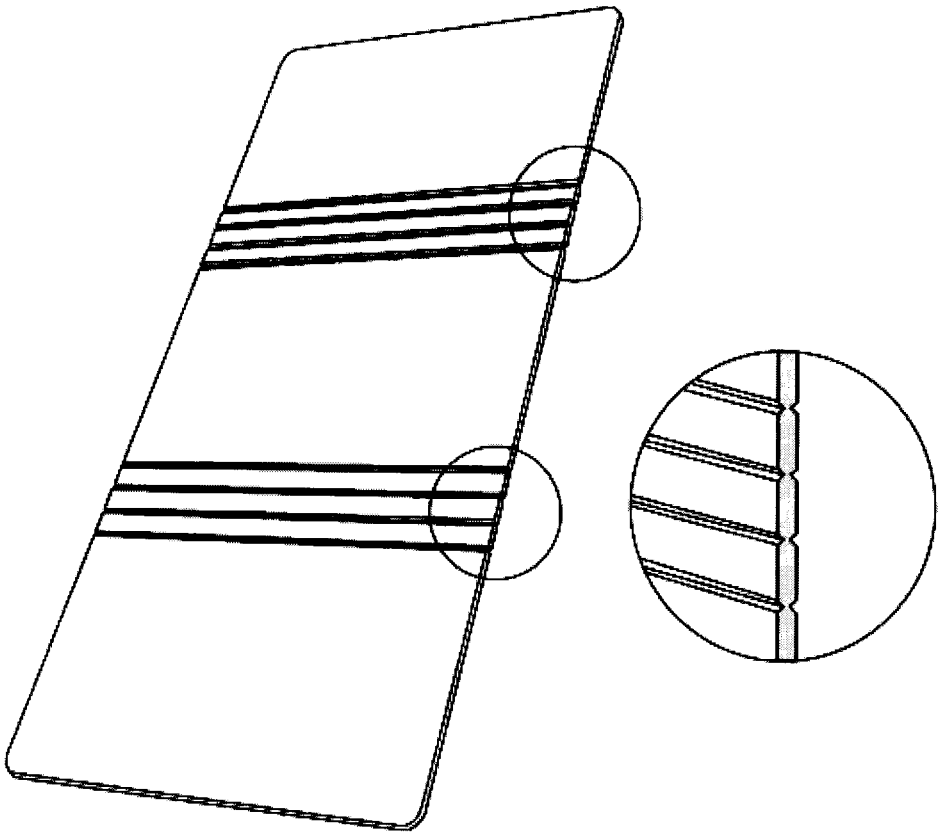
FIGS. 9*a* and 9*b* illustrate particular embodiments of the present invention, showing the definition of the intermediate area or web on a single piece of material that forms the folding guide, indentation and scoring respectively.
Figure 9B:
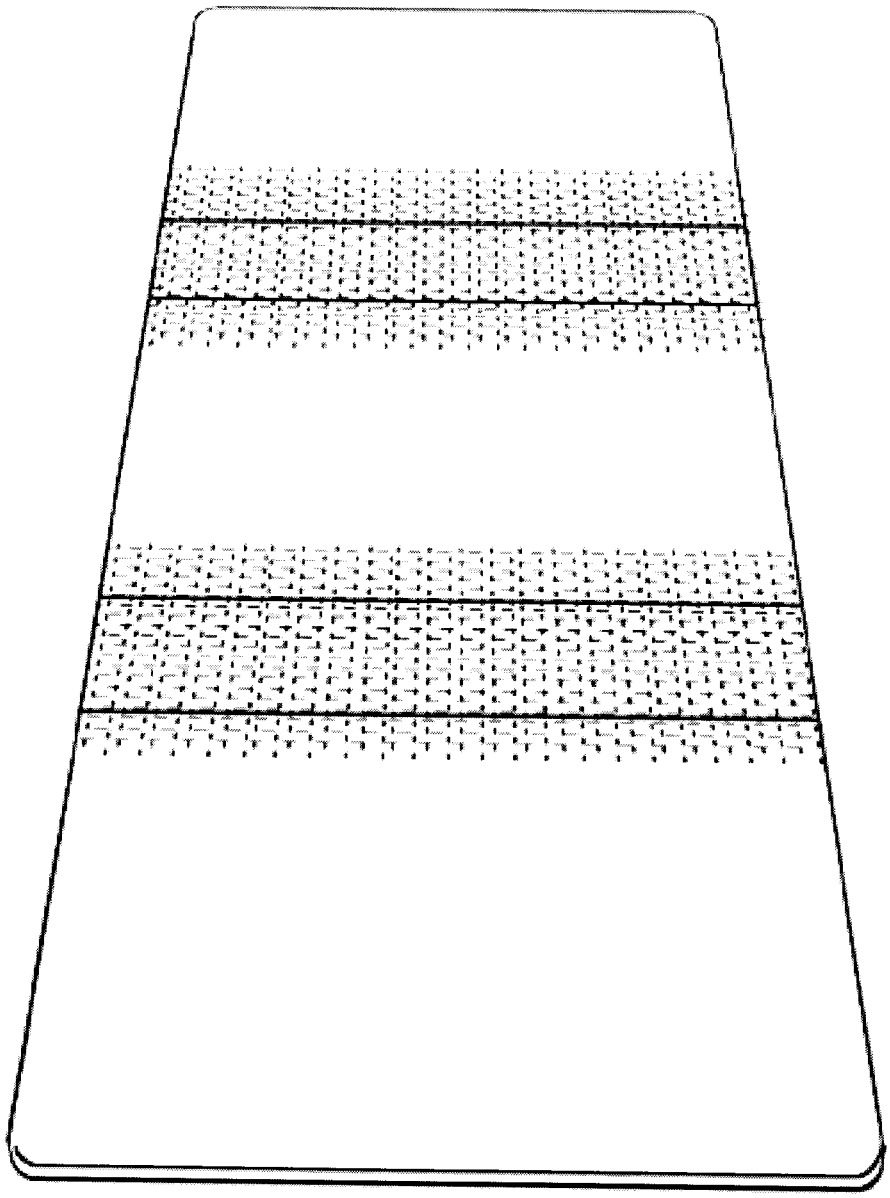

FIGS. 9*a* and 9*b* illustrate particular embodiments of the present invention, showing the definition of the intermediate area or web on a single piece of material that forms the folding guide, indentation and scoring respectively. The treatment of the material in this way enables the formation of the intermediate areas or flexible webs, while conveniently enabling the use of a single piece of material.

The present invention contemplates the use of bags, boxes or other containers, sized to store particular number of items of clothing, folded in accordance with the present invention. An example of a box in accordance with the present invention is illustrated in FIG. 7*g*. Such a box can be stored on a shelf for example, or in a drawer. The bag, box or container, sized for use as part of the system of the present invention, in a drawer for example can provide some structure that supports a plurality of folded shirts (for example) using the folding guide of the present invention. Inserts for suitcases are also contemplated, or in fact suitcase can be designed to receive items of clothing folded in accordance of the present invention. The containers or inserts for suitcases can be made of a variety of materials for example a fabric, arranged for the box or container to generally maintain its shape. The present invention also contemplates providing a variety of sizes and shapes of boxes, with a customer being given the option to order from a variety of sizes or boxes, shapes of boxes, colour etc., via a website or otherwise. The boxes can be made with or without a top portion, for example, a lid that can be fastened (for example using a ZIPPER™) to keep dust or odours from entering the box.

The boxes for example that are part of the system of the present invention, may include a pocket or insert for receiving labelling, for example to indicate the contents of the box.

In one particular aspect of the present invention, the system consists of one or more containers, specifically sized to store one or more items of clothing folded using the folding guide, with the folding guide disposed within such items of clothing, the items of clothing fitted within the one or more containers. The containers can be of different sizes, suited to store items of clothing of different sizes when folded, and organized in different arrangements within the containers. The system may include a specific number of folding guides, possibly of different sizes. The system may be accompanied with a guide to suggest the folding method, and also optimal arrangements of folded clothing within the containers, and different uses of the containers and folding guides for folding and storing different types of clothing. The present invention contemplates the creation of one or more guides or FAQs covering the use of the system, and the various aspects of the folding method, which can be distributed in print form, electronically on a storage medium accompanying the containers and folding guides, or which can be made available electronically via an Internet network.

It should be understood that modifications to the present invention are possible without departing from the scope of the invention. For example, instead of using a web, the thickness of the material used in forming the folding guide (10) can be modified so that it is thinner and easier to bend in the areas disposed between the sections (12). Different fabrics can be used for the two pieces of materials, for example, design fabric, fabric containing licensed material, etc. The present invention can be used to fold any items of clothing where it would be desirable to fold them uniformly, and consequently enable storage in an efficient and neat manner, and making it easier to see and retrieve items stored in accordance with the present invention. The number of sections can be altered, adding more sections as many times as it is desirable to fold particular items of clothing.

The folding guide can be used, or a modified version that incorporates the elements and functionality described to provide a folding guide that acts as a pant folder, folder for fabrics, linens (whether towels, table linens, bed linens) etc. It should be understood that the web (14) is generally sized to conform to the thickness of the article made of fabric that is folded using the folding guide. For example, the folding guide (10) for towels or fabric will generally have a wider web (14) to accommodate the larger bend or curve of the fabric that will be present after the towel or fabric has been folded.

Folding of items of clothing in accordance with the present invention, and storing of the clothing in an organized and compressed form can result in saving 20-30% of space, in part because of the uniform size. The items of clothing or articles of fabric, organized using the present invention, and placed in a container as described above can be placed on higher shelves or further back on deeper shelves, thereby providing better use of such space while still making it relatively easy to access the stored items without the need to re-organize items when one or more of the items are removed, as explained above.

The present invention presents the opportunity to avoid the cost and time involved in accessing storage space and the back and forth trips between the residence and the storage space. The present invention also enables much more efficient retrieval of items and less need to re-organize remaining items after one or more of them have been retrieved. The folded items, in accordance with the present invention, enable an individual to easily see and feel what the folded items are, making searching for items much easier.

Use of the present invention provides a far more organized visual impression for stored items, resulting in satisfaction from the greater visual order and reduction in frustration that normally results from seeing chaotically stored items or trying to access specific items using prior art technologies.

The present invention contemplates the use of ancillary items such as for example collar pieces to maintain a shirt collar in place. The collar piece may consist of a semi-rigid band that is sized to fit under the collar and which can be attached at its ends to form a loop around the collar.

It is contemplated that instructions may be printed on one or more panels of the folding guide (10). The folding guide could be scented, and could include an anti-humidity layer.

The present invention, with the items arranged in a container as described above enables the better utilization of storage space (for example higher shelves, or back portions of shelves) while still ensuring that items are relatively easy to access.

It is noted that the system, apparatus, and method of the present invention improves the transportation of clothing and other items made of fabric by enabling these items to be maintained in a neatly folded state. For example, a container in accordance with the present invention, sized to fit within a suitcase or gym bag, receives one or more items folded using the folding guides, can be transported inside the suitcase or gym bag. For business travellers especially, this enables items that would otherwise require pressing or ironing to be kept in a neat state where such ironing or pressing is no longer required.

As a specific feature of the folding guides (10) of the present invention, the edges may be rounded, as shown in the Figs., in order to help avoid creases.

It should be understood that to organize a defined list of clothing items, it may by useful to use a range of folding guides of different sizes, and particular numbers of folding guides of specific size. The present invention contemplates the use of a calculator that, based on input regarding the clothing items, suggests possible arrangements of the clothing/folding guides for efficient storage configuration of the clothing using particular numbers and sizes of folding guides of the present invention. The calculator may be implemented using a web application component, and may be used to deliver the calculation functionality via operation of an associated website. The web application component may be implemented as part of a web application or computer program, provided in a manner known to those skilled in the art, and loaded onto or provided to a web server. A user may enter the number of clothing items in specific categories; and particular aspects of the storage space available. The calculator is operable to calculate the number of different items of the folding system to organize the specific clothing items, which may be included in an online order.

Figure 10:
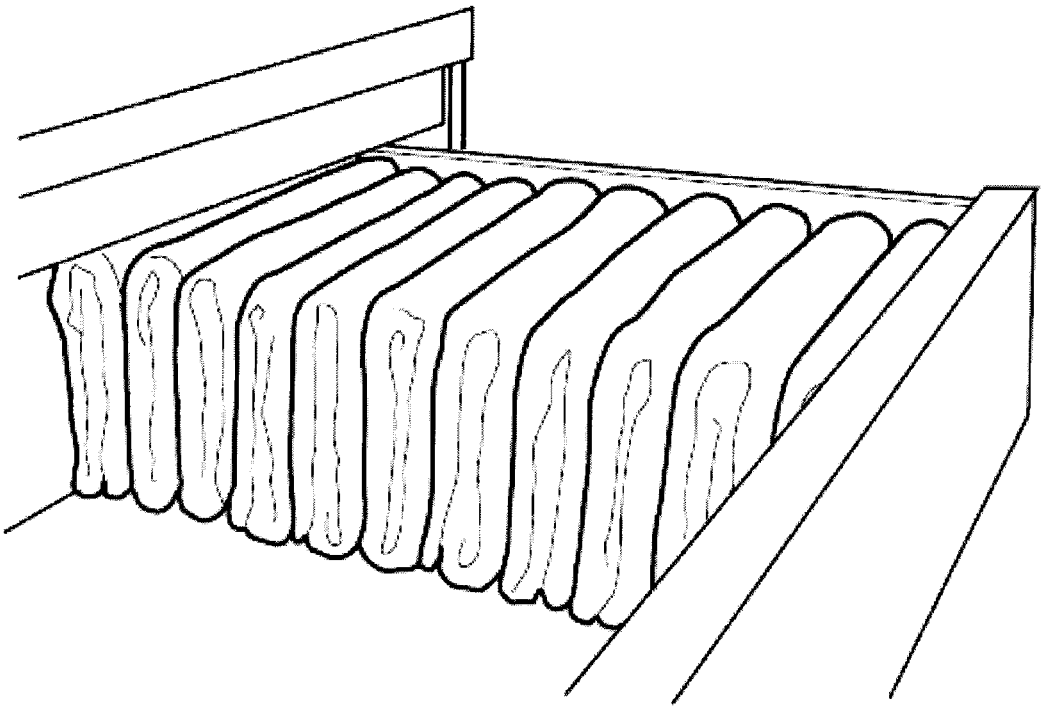
FIG. 10 illustrates the vertical placement of articles of clothing including the folding guides, placed in a standard drawer.

FIG. 10 illustrates the vertical placement of articles of clothing including the folding guides, placed in a standard drawer. As explained above, the present invention enables the vertical placement of articles of clothing, which provides efficient use of the storage space and access to individual articles of clothing in a way that the remaining articles of clothing remain in place.

Figure 11:
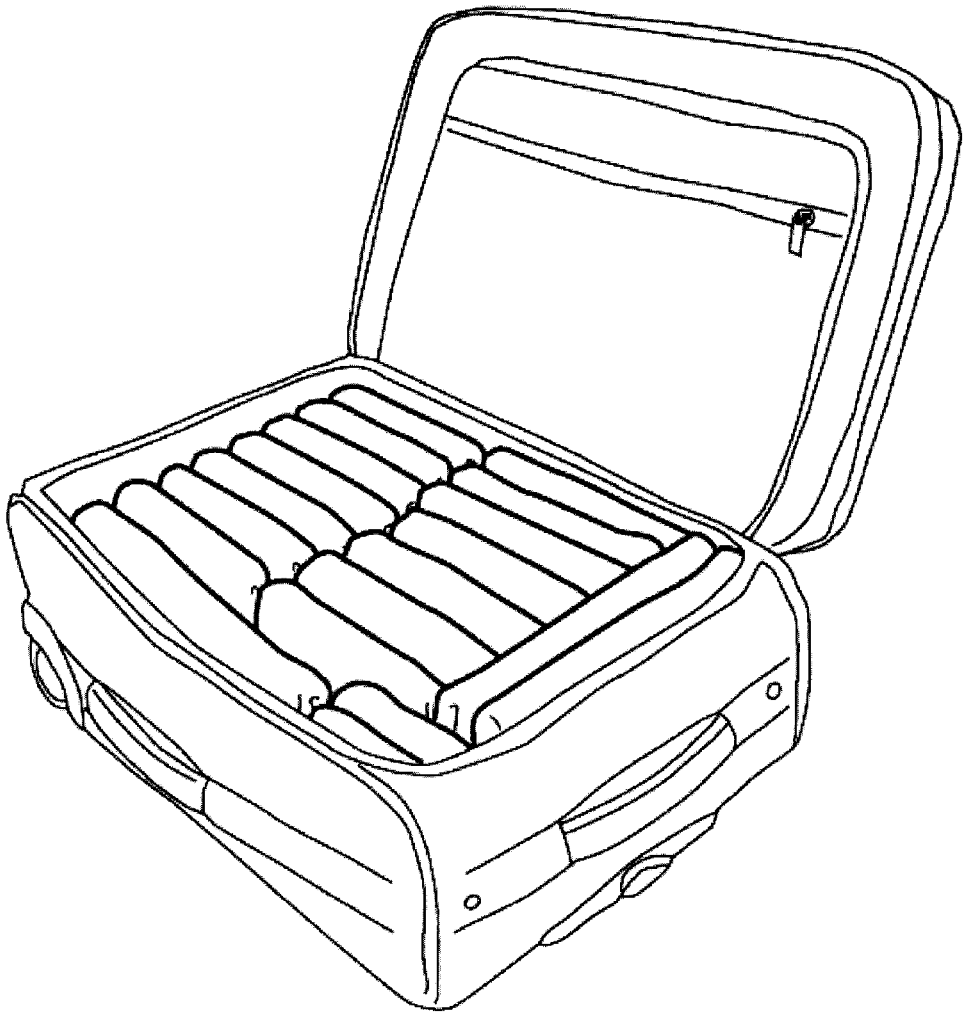
FIG. 11 illustrates the vertical placement of articles of clothing including the folding guides, placed in a suitcase.

FIG. 11 illustrates the vertical placement of articles of clothing including the folding guides, placed in a suitcase. The use of the present invention in suitcases also enables ready access to items of clothing. The items of clothing, placed vertically, can be removed from the suitcase without significant disturbance of the other items, thereby obviating the need to re-organize the other items after removal of one or more items.

Figure 12A:
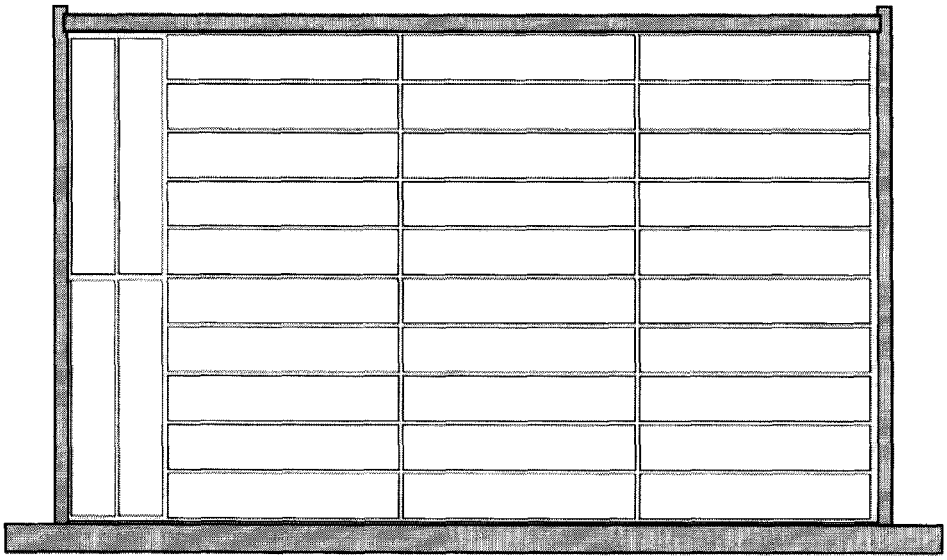
FIGS. 12*a* and 12*b* illustrate the way in which the present invention enables better utilization of existing storage space, and provides better visibility of stored items using the present invention.
Figure 12B:
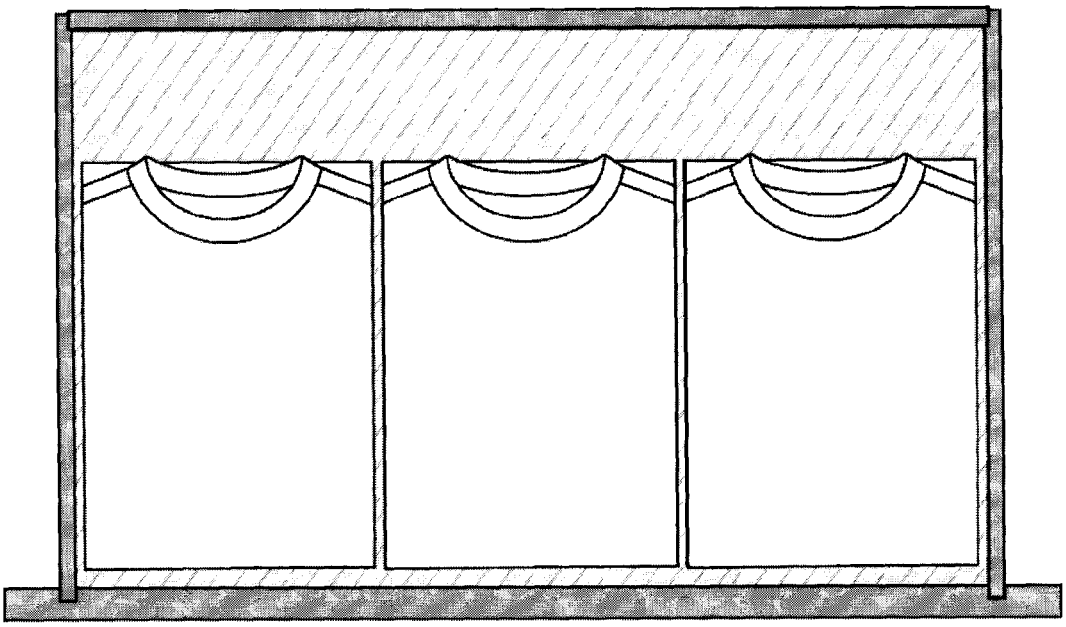

FIGS. 12*a* and 12*b* illustrate the way in which the present invention enables better utilization of existing storage space, and also provide increased visibility of clothing inventory. FIG. 12*b* illustrates the prior art approach, and shows that in most drawers for example, based on their dimensions, and the size of clothing such as shirts, these items are folded in two such that the back portion shown in FIG. 12*b* remains unused. In contrast, FIG. 12*a* shows that the vertical placement of items of clothing, for example in a drawer, enables the arrangement of the items of clothing in a more efficient manner. The drawer used for this comparison is a standard drawer (from one of the most popular Ikea dressers) with the following interior measurements—width: 28", depth 16¾", height 6¼". Using the folding guides of the present invention, 34 tops may be stored in such a standard drawer, as shown in FIG. 12*a*. Using the traditional folding and arrangement method shown in FIG. 12*b*, only 24 tops can be stored because of the unused space.

It will be appreciated by those skilled in the art that other variations of the embodiments described herein may also be practiced without departing from the scope of the invention. Other modifications are therefore possible.

We claim:

1. A folding system for fabric articles, comprising:

a plurality of folding guides, each of the plurality of folding guides including two or more sections of a generally rectangular, generally flat, and substantially rigid material, and a flexible material acting as a joint provided between each of the sections of substantially rigid material, the flexible material acting as the joint being spanned and selectively reinforced by three or more elongate strips spaced from one another, such that the joint bends to define a folding location;

wherein the folding guides are sized so as to be placed in contact with respective fabric articles so as to fold those fabric articles in respective folding patterns defined by the plurality of folding guides and their joints such that each of the plurality of folding guides remains folded within one of the fabric articles; and wherein the plurality of folding guides allow the folded fabric articles to be stored generally vertically.

2. The folding system for fabric articles of claim 1, further comprising a container sized and adapted to hold the folded fabric articles generally vertically, resting on thin edges thereof, adjacent to one another, such that substantially all of the stored articles are visible in a plan view.

3. The folding system for fabric articles of claim 1, wherein at least some of the plurality of folding guides comprise three sections of the generally rectangular, generally flat, and substantially rigid material.

4. The folding system for fabric articles of claim 1, wherein at least some of the plurality of folding guides have rounded corners.

5. The folding system for fabric articles of claim 1, wherein ones of the plurality of folding guides have different size and shape parameters to correspond with different types of fabric articles.

6. The folding system for fabric articles of claim 1, wherein the fabric articles are fabrics, articles of clothing, or linens.

7. The folding system for fabric articles of claim 1, wherein the system includes or is associated with a computer implemented system adapted to:

allow a user to provide as input one or more parameters for one or more of the fabric articles and one or more parameters for available storage spaces;

analyze the one or more parameters for the one or more of the fabric articles and the one or more parameters for the available storage spaces; and generate a recommended set of folding guide requirements for the user, including a recommended number of folding guides having a particular size or other attributes.

8. A folding guide, comprising:

two or more sections of a generally rectangular, generally flat, and substantially rigid material; and a flexible material acting as a joint provided between each of the sections of substantially rigid material, the flexible material acting as the joint being spanned and selectively reinforced by three or more elongate strips spaced from one another, such that the joint bends to define a folding location;

wherein the folding guide is sized so as to be placed in contact with a fabric article so as to fold the fabric article in a folding pattern defined by the folding guide and its joint or joints such that the folding guide remains folded within the fabric article.

9. The folding guide of claim 8, wherein the folding guide provides sufficient rigidity to store the fabric article vertically in a self-supporting fashion.

10. The folding guide of claim 8, wherein the folding guide comprises three sections.

11. The folding guide of claim 8, wherein the folding guide has rounded corners.

12. The folding guide of claim 8, wherein the fabric article comprises fabric, an article of clothing, or linens.

13. A folding and storage method, comprising:

placing a folding guide in a defined position in contact with an unfolded fabric article, the folding guide including two or more sections of a generally rectangular, generally flat, and substantially rigid material, and a flexible material acting as a joint provided between each of the respective ones of the two or more sections of substantially rigid material, the flexible material acting as the joint being spanned and selectively reinforced by three or more elongate strips spaced from one another, such that the joint bends to define a folding location when the folding guide is folded with the fabric article;

folding the fabric article so as to encapsulate the folding guide within the fabric article, at least one fold being made at the folding location defined by the joint in the folding guide;

repeating said placing and said folding with other unfolded fabric articles to create a plurality of folded fabric articles; and arranging the plurality of folded fabric articles adjacent one another in a container or on a support with their respective encapsulated folding guides such that each of the plurality of folded fabric articles rests on an interior bottom surface of the container and the folded fabric article extends generally vertically therefrom, such that essentially the entire plurality of folded fabric articles are visible in a plan view.

14. The method of claim 13, wherein the folding guide comprises three sections.

15. The method of claim 13, wherein the folding guide has rounded corners.

16. The method of claim 13, wherein the container is a drawer or a travel suitcase.

17. The method of claim 13, wherein the support comprises a generally horizontal shelf.

18. The method of claim 13, further comprising removing one of the plurality of folded articles without disrupting the placement of others of the plurality of folded articles in the container.

19. The method of claim 13, wherein said folding comprises:

folding the fabric article against side edges of the folding guide;

folding the fabric article against top and bottom edges of the folding guide; and folding the fabric article at the folding location defined by the folding guide.

* * * * *